US006284806B1

(12) United States Patent
Chakrabarty et al.

(10) Patent No.: US 6,284,806 B1
(45) **Date of Patent: *Sep. 4, 2001**

(54) WATER EMULSIONS OF FISCHER-TROPSCH WAXES

(75) Inventors: Tapan Chakrabarty, Calgary (CA); Robert J. Wittenbrink, Baton Rouge, LA (US); Paul J. Berlowitz, E. Windsor, NJ (US); Loren L. Ansell, Baton Rouge, LA (US)

(73) Assignee: Exxon Research and Engineering Company, Annandale, NJ (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

This patent is subject to a terminal disclaimer.

(21) Appl. No.: 08/928,237

(22) Filed: Sep. 12, 1997

(51) Int. Cl.[7] ..... B01F 3/12; B01F 17/42; C10L 1/32

(52) U.S. Cl. ..... 516/77; 516/924; 516/928; 44/280; 44/302; 137/13

(58) Field of Search ..... 252/311; 516/51, 516/76, 77, 924, 928; 44/301, 280, 302; 137/13

(56) References Cited

U.S. PATENT DOCUMENTS

| | | | | |
|---|---|---|---|---|
| 3,551,169 | * | 12/1970 | Cangdon | 252/311 |
| 3,553,130 | * | 1/1971 | Stratton | 507/262 |
| 3,630,953 | * | 12/1971 | Simon et al. | 516/51 |
| 3,776,248 | * | 12/1973 | Titus | 137/13 |
| 3,985,932 | * | 10/1976 | Porter | 428/326 |
| 4,374,879 | * | 2/1983 | Roberts et al. | 428/35 |
| 4,435,309 | * | 3/1984 | House | 252/311 |
| 4,675,022 | * | 6/1987 | Danner | 8/115.56 |
| 4,793,850 | * | 12/1988 | Koester et al. | 71/79 |
| 4,832,774 | * | 5/1989 | DiFrank et al. | 156/215 |
| 5,236,624 | * | 8/1993 | Lepert et al. | 252/314 |
| 5,283,001 | * | 2/1994 | Gregoli et al. | 44/301 |
| 5,348,982 | * | 9/1994 | Herbolzheimer et al. | 518/700 |
| 5,387,434 | * | 2/1995 | Black | 134/34 |
| 5,405,439 | * | 4/1995 | Marchal et al. | 106/277 |
| 5,545,674 | * | 8/1996 | Behrmann et al. | 518/715 |

FOREIGN PATENT DOCUMENTS

| | | | | |
|---|---|---|---|---|
| 2159942 | * | 4/1996 | (CA) . | |
| WO9708276 | | 3/1997 | (WO) | C10L/1/32 |

OTHER PUBLICATIONS

McCutcheon's vol. 1: Emulsifiers & Detergents, 1993 North American Edition (McCutcheon Division, MC Publishing Co. Glen Rock, NJ. copyright date 1993) p. 86, Jan. 1994.*

Hackh's Chemical Dictionary, Edited By Julius Grant (McGraw–Hill Book Co., NY, NY copyright 1972) pp. 721–722, Dec. 1979.*

H. Bennet, Practical Emulsions A Handbook of Emulsions, Emulsifiers and methods of formulating and making Emulsions of Practical value in Industry (Chemical Publishing, NY, NY copyright 1943) pp. 438–447, Aug. 1943.*

* cited by examiner

*Primary Examiner*—Daniel S. Metzmaier
(74) *Attorney, Agent, or Firm*—Jay Simon; Charles J. Brumlik

(57) ABSTRACT

Hydrocarbon in water emulsions comprising Fischer-Tropsch process water, at least 20 to about 90 weight percent of a Fischer-Tropsch wax, a first nonionic surfactant having an HLB of at least 11 and a second nonionic surfactant having an HLB less than 11. Said emulsions are liquid at room temperature and pour by ordinary gravity. Also disclosed are methods of making said hydrocarbon in water emulsions.

7 Claims, No Drawings

WATER EMULSIONS OF FISCHER-TROPSCH WAXES

FIELD OF THE INVENTION

This invention relates to stable, macro emulsions comprising Fischer-Tropsch waxes and water.

BACKGROUND OF THE INVENTION

Hydrocarbon-water emulsions are well known and have a variety of uses, e.g., as hydrocarbon transport mechanisms, such as pipelines. These emulsions are generally described as macro emulsions, that is, where the emulsion is cloudy or opaque as compared to micro emulsions that are clear, translucent, and thermodynamically stable because of the higher level of surfactant used in preparing micro-emulsions.

The methods of making, e.g., wax emulsions, from petroleum derived materials are well known, but the material surfactants and co-solvents are usually expensive. Moreover, waxes produced from the Fischer-Tropsch process may be harder waxes, have higher melting points, are essentially odor free and free of sulfur and nitrogen, with low residual oils. These high melting point solids are, therefore, difficult to transport through pipelines.

Consequently, there is a need for a method of preparing low cost, stable emulsions of Fischer-Tropsch wax so the wax can be readily transported, e.g., through pipelines.

SUMMARY OF THE INVENTION

In accordance with this invention a stable, macro emulsion wherein water is the continuous phase is provided and comprises Fischer-Tropsch derived hydrocarbon waxes, water, and a first non-ionic surfactant and a second non-ionic surfactant. Preferably, the emulsion is prepared in the substantial absence, e.g., ≦2 wt %, and preferably less than 1 wt %, absence of the addition of a co-solvent, e.g., alcohols, or in the substantial absence of co-solvent, that is, Fischer-Tropsch waxes may contain trace amounts of oxygenates, including alcohols; these oxygenates make up less oxygenates than would be present if a co-solvent was included in the emulsion. Generally, the alcohol content of the Fischer-Tropsch derived wax is less than about 2 wt % based on the wax, more preferably less throughout 1 wt % based on the wax.

The macro-emulsions that are the subject of this invention are generally easier to prepare and are more stable than the corresponding emulsion with petroleum derived hydrocarbons. For example, at a given surfactant concentration, the degree of separation of the emulsions is significantly lower than the degree of separation of emulsions containing petroleum derived hydrocarbons. Furthermore, the emulsions require the use of less surfactant than required for emulsions of petroleum derived hydrocarbon liquids, and do-not require the use of co-solvents, such as alcohols, even though small amounts of alcohols may be present in the emulsions.

PREFERRED EMBODIMENTS

The Fischer-Tropsch derived waxes used in this invention are those hydrocarbons containing materials that are solid at room temperature. Thus, these materials may be the raw wax from the Fischer-Tropsch hydrocarbon synthesis reactor, such as $C_4$+ wax, preferably $C_5$+ wax. These materials generally contain at least about 90% paraffins, normal or iso-paraffins, preferably at least about 95% paraffins, and more preferably at least about 98% paraffins.

Generally, the emulsions contain up to about 90 wt % Fischer-Tropsch derived wax, preferably 20 to 90 wt % wax, more preferably 60 to 90 wt % Fischer-Tropsch derived wax. Any water may be used; however, the water obtained from the Fischer-Tropsch process is particularly preferred.

Fischer-Tropsch derived materials usually contain few unsaturates, e.g., ≦1 wt % olefins & aromatics, preferably less than about 0.5 wt % total aromatics, and nil-sulfur and nitrogen, i.e., less than about 50 ppm by weight sulfur or nitrogen.

The non-ionic surfactant is usually employed in relatively low concentrations. Thus, the total surfactant concentration, that is, just surfactant plus second surfactant is that sufficient to allow the formation of the macro, relatively stable emulsion. Preferably, the total amount of surfactant employed is at least about 0.005 wt % of the total emulsion, more preferably about 1–10 wt % and most preferably 1 to about 7 wt %. The first surfactant is typically a non-ionic surfactant having an HLB (hydrophilic-lipophilic balance) of at least 11, preferably about 11–15 and the second surfactant is a non-ionic surfactant having an HLB of less than 11, preferably 8 to less than 11.

Typically, non-ionic surfactants useful in preparing the emulsions of this invention are those used in preparing emulsions of petroleum derived or bitumen derived materials, and are well known to those skilled in the art. Useful surfactants for this invention include alkyl ethoxylates, linear alcohol ethoxylates, and alkyl glucosides, and mono and di-alkyl substituted ethoxylated, phenols wherein the number of ethenoxy (EO) groups in the first surfactant are about 8 to 20, and in the second surfactant are 3 to 7. A preferred surfactant is an alkyl phenoxy poly alcohol.

The emulsions of this invention are prepared by a two step process: (1) forming a thick mixture of wax, water, and the first surfactant, i.e. a "pre-emulsion", and (2) mixing the product of step 1 with the second surfactant to form the stable emulsion.

Step 1 is effectively carried out by melting the wax, usually by heating in excess of about 80° C., mixing the wax with water and the first surfactant, and providing sufficient shear to produce a pre-emulsion or a thick emulsion. Preferably, the water and surfactant are also heated to about the same temperature as the wax. It is also preferred to mix the water and surfactant prior to mixing either with the wax. The resulting mixture is usually cooled to ambient temperature, although not always necessarily, before carfying out Step 2. Upon mixing the pre-emulsion with the second suifactant, the mixture is again subjected to sufficient shear for a time period sufficient to form a stable, macro emulsion. The degree of shear for each step as well as shear time for each step may be readily determined with minimal experimentation.

While any suitable mixing or shearing device may be used, static mixers as described in U.S. Pat. Nos. 5,405,439, 5,236,624, and 4,832,747 and incorporated herein by reference are preferred for forming the wax emulsions of this invention.

To more completely describe this invention, a series of examples, including comparison tests, are described and present in outline form in Table 4 herein below.

The Fischer-Tropsch process is well known to those skilled in the art, see for example, U.S. Pat. No. 5,348,982 and 5,545,674 incorporated herein by reference and typically involves the reaction of hydrogen and carbon monoxide in a molar ratio of about 0.5/1 to 4/1, preferably 1.5/1 to 2.5/1, at temperatures of about 175–400° C., preferably about 180°–240°, at measures of 1–100 bar, preferably about 10–40 bar, in the presence of a Fischer-Tropsch catalyst, generally a supported or unsupported Group VIII, non-noble metal, e.g., Fe, Ni, Ru, Co and with or without a promoter, e.g. ruthenium, rhenium, hafnium, zirconium, titanium. Supports, when used, can be refractory metal oxides such as Group IVB, i.e., titania, zirconia, or silica, alumina, or silica-alumina. A preferred catalyst comprises a non-shifting catalyst, e.g., cobalt or ruthenium, preferably cobalt with ruthenium, rhenium or zirconium as a promoter, preferably rhenium supported on silica or titania, preferably titania. The Fischer-Tropsch liquids, i.e., $C_5$+, preferably $C_{10}$+, are recovered and light gases, e.g., unreacted hydrogen and CO, $C_1$ to $C_3$ or $C_4$ and water are separated from the hydrocarbons.

The non-shifting Fischer-Tropsch process, also known as hydrocarbon synthesis may be shown by the reaction.

$$(2n)H_2+nCO \rightarrow C_nH_{2n+2}+nH_2O$$

A preferred source of water for preparing the emulsions of this invention is the process water produced in the Fischer-Tropsch process, preferably a non-shifting process. A generic composition of this water is shown below and in which oxygenates are preferably ≦2 wt %, more preferably less than 1 wt %: 12

| | |
|---|---|
| $C_1$–$C_{12}$ alcohols | 0.05–2 wt %, preferably 0.05–1.5 wt % |
| $C_2$–$C_6$ acids | 0–50 wppm |
| $C_2$–$C_6$ ketones, aldehydes, acetates | 0–50 wppm |
| other oxygenates | 0–500 wppm |

Example 1 (Comparative):

The conventional method for preparing emulsions entails melting the wax and blending the melted wax with hot water in the presence of a surface active ingredient. This example shows that the conventional method is not effective for preparing a concentrated wax in water emulsion that is stable and can be transported by pipeline.

A $C_{10}$+ solid wax, i.e., $C_{10}$–$C_{100}$, from a Fischer-Tropsch process utilizing a cobalt/rhenium on titania catalyst and having an average molecular weight of 577 (determined by high resolution mass spectrometry), C-85%, H-14.94%, density of about 0.8/0.85 gm/cc, was heated to 85° C. and melted, in an oven. 35ml of Fischer-Tropsch process water (specific composition shown in Table 1), a preferred water source for this invention, having the generic composition shown above was also heated to 85° in a Waring blender. 1.75 gm of an ethoxylated nonyl phenol surfactant with 9 moles of ethylene oxide (O) was added to the water and the mixture was mixed at 1000 rpm for 30 seconds to fully mix the water and surfactant. 80 ml of molten wax was added to the water-surfactant mixture in the blender and blended at 10,000 rpm for 20 seconds, created a wax-in-water emulsion containing 70% wax and 1.8% surfactant with the remainder being Fischer-Tropsch process water. Upon cooling to ambient temperature, the emulsion became too thick (paste like) to be transported by pipeline.

Two other tests were performed using the same surfactant but with 15 EO's and 20 EO's. In both cases, the wax-in-water emulsions when cooled to ambient (room) temperature became thick and paste like.

Additional tests with the same materials but with reduced amounts of wax showed that stable emulsions could not be made with wax contents of greater than 20 vol %.

Example 2: (Emulsification by this Invention)

This Example shows how a stable concentrated emulsion can be prepared according to the present invention.

A 70% (by volume) wax-in-water emulsion was created at elevated temperature following the first part of the procedure of Example 1. The surfactant was an ethoxylated nonyl phenol with 9 moles of EO. The emulsion was cooled to room temperature. As in Example 1, the emulsion became paste like and did not pour (similar to a petroleum jelly). Then 3.0 g of a second surfactant with 5 moles of EO was added to the emulsion and the mixture blended for 5 minutes at 3000 rpm in the Waring blender at room temperature. The paste like emulsion became pourable. The total surfactant concentration in the emulsion was 4.8% by weight. No additional water was added in the second step and, hence, the water content was still 30% by volume. The emulsion was stable for at least 5 months.

This Example shows that a 70% by volume wax-in-water emulsion can be prepared using the two-step emulsification process. The emulsion is a stable, favorable liquid at room temperature, e.g., pours by ordinary gravity.

Example 3: (Comparative) Addition of Both Surfactants at Elevated Temperature Example 2 used two surfactants, one with 9 EO at 85° C. and the other with 5 EO at room temperature. This Example shows that the inclusion of both surfactants at 85° C. is not effective in preparing a stable emulsion useful for pipeline transport.

The proportion of wax and water in the emulsion, and the emulsification conditions in this Example were the same as those in Example 1, the only difference being that both surfactants (one with 9 EO and the other with 5 EO) were added at 85° C. A wax-in-water emulsion was created at 85° C. which upon cooling to room temperature became thick. The thick emulsion was not favorable, and therefore was not suitable for pipeline transport.

Example 4 (Comparative) Addition of Both Surfactants at Room Temperature

Solid wax and F/T process water were blended at room temperature using the same proportion as that in Example 1. The surfactant with 9 EO was added first. This created a granular thick paste. Upon addition of the surfactant with 5 EO, the paste became thinner with smaller grains of solid wax.

Example 5 (Comparative Emulsification with 9 EO Surfactant at Room Temperature

An attempt to make an emulsion using 1.8% 9 EO surfactant with the balance being a 70:30 ratio of wax and process water at room temperature was unsuccessful; a thick paste was formed.

Example 6 (Comparative) Emulsification with 5 EO Surfactant at 85° C.

An attempt to make an emulsion using 1.8% 5 EO surfactant with the balance being a 70:30 ratio of wax and process water was unsuccessful; a thick paste was formed at 85° C. On cooling the emulsive, thinned somewhat, but was still of much higher consistency than required for pipeline transport.

Example 7: Blending by the Method of This Invention with Conventional Water

An attempt to make an emulsion using 70% wax, 30% water, and surfactants exactly as per Example 2 above, was made with conventional distilled water instead of Fischer-Tropsch process water. In this case, while not all of the water could be incorporated into the emulsion during the first step, the emulsion was stable, favorable and adequate for pipeline transport, although there was a separate water phase. Thus, Fischer-Tropsch process water shows an advantage in preparing the wax-water emulsion.

TABLE 1

| Composition of Fischer-Tropsch Process Water | | |
|---|---|---|
| Compound | wt % | ppm O |
| Methanol | 0.70 | 3473.2 |
| Ethanol | 0.35 | 1201.7 |
| 1-Propanol | 0.06 | 151.6 |
| 1-Butanol | 0.04 | 86.7 |
| 1-Pentanol | 0.03 | 57.7 |
| 1-Hexanol | 0.02 | 27.2 |
| 1-Heptanol | 0.005 | 7.4 |
| 1-Octanol | 0.001 | 1.6 |
| 1-Nonanol | 0.0 | 0.3 |
| Total Alcohols | 1.20 | 5007.3 |
| Acid | wppm | wppm O |
| Acetic Acid | 0.0 | 0.0 |
| Propanic Acid | 1.5 | 0.3 |
| Butanoic Acid | 0.9 | 0.2 |
| Total Acids | 2.5 | 0.5 |
| Acetone | 17.5 | 4.8 |
| Total Oxygen | | 5012.6 |

TABLE 2

SUMMARY OF METHODS AND RESULTS

| Example | Stage 1 | Stage 2 | Result |
|---|---|---|---|
| 1 | 85° C.: 9EO surfactant 70% wax | none | thick paste |
| | 85° C.: 15EO surfactant 70% wax | none | thick paste |
| | 85° C.: 20EO surfactant 70% wax | none | thick paste |
| | 85° C.: 9EO surfactant <20% wax | none | good emulsion |
| 2 | 85° C.: 9EO surfactant 70% wax | RT: 5 EO surfactant | good, stable emulsion |
| 3 | 85° C.: 9EO + 5 EO surfactants 70% wax | none | thick paste |
| 4 | RT: 9EO + 5 EO surfactants 70% wax | none | thin, granular paste |
| 5 | RT: 9EO surfactant 70% wax | none | thick paste |
| 6 | 85° C.: 5EO surfactant 70% wax | none | thick paste |
| 7 | 85° C.: 9EO surfactant 70% wax, distilled water | RT: 5 EO surfactant | partial good emulsion |

RT = room temperature.

What is claimed is:

1. A hydrocarbon in water emulsion comprising:

Fischer-Tropsch process water;

at least 20 to about 90 weight % of a Fischer-Tropsch derived wax;

from about 2.25 to 5 weight % based on the weight of wax and water of a first nonionic surfactant having an HLB of at least 11; and from about 0.05 to 5 weight % based on the weight of wax and water of a second nonionic surfactant having an HLB of less than 11; and wherein said emulsion is liquid at room temperature and pours by ordinary gravity.

2. The emulsion of claim 1 wherein the first and second surfactants are selected from mono- and dialkyl ethoxylated phenols having from 2 to 20 carbon atoms in the alkyl groups.

3. A method of forming a wax in water emulsion having greater than 20 to about 90 wt % Fischer-Tropsch wax comprising:

melting a Fischer-Tropsch wax by heating;

mixing at least 20 to about 90 wt % of the melted Fischer-Tropsch wax with Fischer-Tropsch process water and a first nonionic surfactant having an HLB of at least 11 to produce a pre-emulsion; and mixing said pre-emulsion with a second nonionic surfactant having an HLB of less than 11 to form a wax on water emulsion; and wherein said emulsion is liquid at room temperature and pours by ordinary gravity.

4. The method of claim 3 wherein the first surfactant has an HLB of about 11–15.

5. The method of claim 3 wherein the second surfactant has an HLB of 8 to less than 11.

6. The method of claim 3 including heating the water and first nonionic surfactant to about the temperature of the melted Fischer-Tropsch wax before mixing the water and surfactant with the wax.

7. The method of claim 6 wherein the pre-emulsion is cooled to a temperature below the melting point of the wax.

* * * * *